US006998960B2

(12) United States Patent
Buschmann et al.

(10) Patent No.: US 6,998,960 B2
(45) Date of Patent: Feb. 14, 2006

(54) METHOD AND APPARATUS FOR MARKING AN ESCAPE ROUTE

(75) Inventors: Michael Buschmann, Willich (DE); Frank Herstix, Neuss (DE); Thomas Goulet, Erkrath (DE); Waldemar Ollik, Rheinberg (DE)

(73) Assignee: Novar GmbH, Neuss (DE)

( * ) Notice: Subject to any disclaimer, the term of this patent is extended or adjusted under 35 U.S.C. 154(b) by 55 days.

(21) Appl. No.: 10/671,631

(22) Filed: Sep. 29, 2003

(65) Prior Publication Data

US 2004/0075572 A1 Apr. 22, 2004

(30) Foreign Application Priority Data

Oct. 2, 2002 (DE) ..... 102 46 033

(51) Int. Cl.
*G08B 5/00* (2006.01)

(52) U.S. Cl. ..... 340/286.05; 340/296.14; 340/525; 52/147

(58) Field of Classification Search ..... 340/286.05, 340/525, 286.14, 287; 52/174
See application file for complete search history.

(56) References Cited

U.S. PATENT DOCUMENTS 4,385,586 A * 5/1983 Schriever ..... 116/205
4,531,114 A 7/1985 Topol et al.
4,737,764 A * 4/1988 Harrison ..... 362/153
4,754,266 A * 6/1988 Shand et al. ..... 340/691.2
5,019,805 A * 5/1991 Curl et al. ..... 340/628
6,025,773 A * 2/2000 Bresnan ..... 340/407.1
6,150,943 A * 11/2000 Lehman et al. ..... 340/628
6,646,545 B1 * 11/2003 Bligh ..... 340/286.05

FOREIGN PATENT DOCUMENTS

| | | | |
|---|---|---|---|
| DE | 2441073 C3 | | 3/1976 |
| EP | 0 361 973 A2 | | 4/1990 |
| GB | 2 215 105 A | | 9/1989 |
| JP | 06231378 | * | 8/1994 |
| WO | WO 00/14693 | | 3/2000 |

* cited by examiner

*Primary Examiner*—Jeffery Hofsass
*Assistant Examiner*—Jennifer Stone
(74) *Attorney, Agent, or Firm*—Edell, Shapiro & Finnman, LLC

(57) ABSTRACT

A method for signaling an escape route in a building with emergency warning units arranged in a distributed way can be realized such that the emergency warning units are equipped with luminous means that in the event of an emergency can be activated by a central emergency warning system sequentially in the manner of a running light that designates the direction of the escape route leading away from a hazard site. An emergency warning unit suitable for this purpose may include two LEDs configured as arrows facing in opposite directions, of which either can be switched into a blinking mode by the central emergency warning system in accordance with the emergency conditions.

17 Claims, 1 Drawing Sheet

METHOD AND APPARATUS FOR MARKING AN ESCAPE ROUTE

BACKGROUND OF THE INVENTION

1. Field of the Invention

The invention relates to a method for marking or signaling an escape route to be taken during an emergency in a building with emergency warning units which are arranged in a distributed manner and are connected to an emergency warning system. The invention further relates to emergency warning units for performing this method.

2. Description of the Related Art

Methods for indicating escape routes by light sources are known from DE-AS 24 41 073, the disclosure of which is incorporated herein by reference in its entirety. Such light sources are arranged in a distributed manner along the entire escape route and form a running light whose color shifts increasingly toward the color green in the direction of the safe end of the escape route or whose brightness decreases or whose rhythm slows down. The light sources are associated with sources of sound which can be excited simultaneously or delayed with the light sources. The light sources can be activated individually or as a running light, for example by an emergency warning unit that has passed into the alarm state. Such proposed systems have not been implemented in practice. Two relevant deficiencies are responsible for this fact, namely, on the one hand the considerable complexity in connection with the equipment and installation which would be necessary even in the case of a limitation to merely the light sources, and on the other hand, the fact that it concerns a kind of static solution which does not take into account that at least on larger buildings there are several separate or intersecting and mutually branching potential escape routes, and the secure escape routes to be used in an actual emergency depend on the location at which the hazard has occurred.

SUMMARY OF THE INVENTION

The invention is therefore based on the object of providing a method of the kind mentioned above, which is accomplished with only a modest increase in technical means with respect to equipment and installation.

This object is achieved in accordance with the invention in such a way that the emergency warning unit is equipped with luminous means which can be activated sequentially in the manner of a running light by a central emergency warning system in the event of a hazard, which running light indicates the escape route leading away from the dangerous location.

This solution has the advantage that, on the one hand, it realizes the principally known running light effect on the basis of the emergency warning system which is present anyway and its installation and, on other hand, it works dynamically, meaning that it signalizes only the secure escape routes and the direction to be chosen, depending on the site of the hazard. On the one hand, the implementation costs are rather moderate because, according to the state of the art, the emergency warning units which are arranged in a distributed manner in a building are always connected to a computer-controlled central system and are powered by the same with supply voltage. On the other hand, light-emitting diodes (LEDs) with a high conversion efficiency are available as an illuminating means which therefore are able to emit light impulses of high intensity in pulsed operation without requiring a significant increase in the supply power to be provided by the central system per warning unit.

Preferably, the method can be realized in such a way that a file which comprises all escape routes of the building and the physical locations of all warning units and a program for determining the escape route(s) depending on one or several incoming emergency messages are stored in the central system, which program calculates the data of the start, direction and end of the escape routes leading away from the determined hazard location(s) and calculates therefrom the sequence of the trigger commands for the luminous means of the emergency warning units to be activated. These trigger commands are usually sent as digital data messages to the individual emergency warning units.

The proposed method can be supplemented in such a way that the luminous means of illuminated escape route signs (e.g., "Exit" or "Emergency Exit" signs) are additionally connected to the central system and that the central system places the escape route signs in a blinking mode which are situated on the determined escape route(s). Normally, the luminous means of escape route signs, which are typically conventional light bulbs, are powered via separate wiring and are permanently illuminated. According to this aspect of the invention, the power supply for the luminous means of the escape route signs can also be connected to and controlled by the central system. The central system can thereby put the luminous means of conventional escape route signs into a blinking mode along with the emergency warning units, and the blinking escape route signs can be integrated into the system of lights creating a running light in the direction of a safe exit In accordance with a further aspect of the invention, the central system identifies and deactivates the luminous means of escape route signs that, in a particular emergency, designate unsuitable or hazardous escape routes (i.e., those escape route signs that would lead fleers in the wrong direction, toward a fire or hazard location). This is a substantial improvement over the current approach, where all conventional, illuminated escape route directional indicators and emergency exit signs are illuminated in the emergency after their activation, which includes routes whose use will not lead away from the hazard site but closer to it.

Like the physical locations of the emergency warning units which can be used for producing the running light effect, the physical locations of the illuminated escape route signs can also be stored in a file in the central system and can be co-processed in the escape route determination program.

The object of the invention is further achieved by the use of automatic or manually activated emergency warning units with LEDs continuously emitting green light in the idle state, such that the LEDs can be switched to a blinking state in an emergency by the central system. For this purpose, usually only a minor change of the software and possibly an additional semi-conductor switch are necessary in the case of microprocessor controlled emergency warning units.

To save supply power, conventional emergency warning units use LEDs with low power consumption and respectively low luminance or radiation intensity for signaling their operating state. Instead of replacing such LEDs by respective LEDs with stronger luminance, the emergency warning unit can be equipped with at least one additional, highly luminous, green-emitting LED which emits only in the case of emergency, namely in a blinking mode which can be activated by a central system.

It is preferable to configure the additional LED physically as an arrow. It is understood that if two alternative escape routes are possible, two such additional LEDs can be present on the emergency warning unit.

The emergency warning units can be automatic warning units which respond to certain conditions such as temperature, smoke, flame, certain gases or other physical phenomena which are typical for hazards. Similarly suitable are manual emergency warning units which are usually wall-mounted and, are triggered in an emergency or danger situation by pressing a push-button or the like and then send a respective message to the central system.

A manual, wall-mountable emergency warning unit in particular can comprise two LEDs in the form of arrows which are arranged to face in opposite directions and of which either the one or the other can be switched by the central system to a blinking mode commensurate with the respective situation.

BRIEF DESCRIPTION OF THE DRAWINGS

The method according to the invention is explained below by reference to schematic drawings, wherein.

DESCRIPTION OF THE PREFERRED EMBODIMENTS

Figure 1:
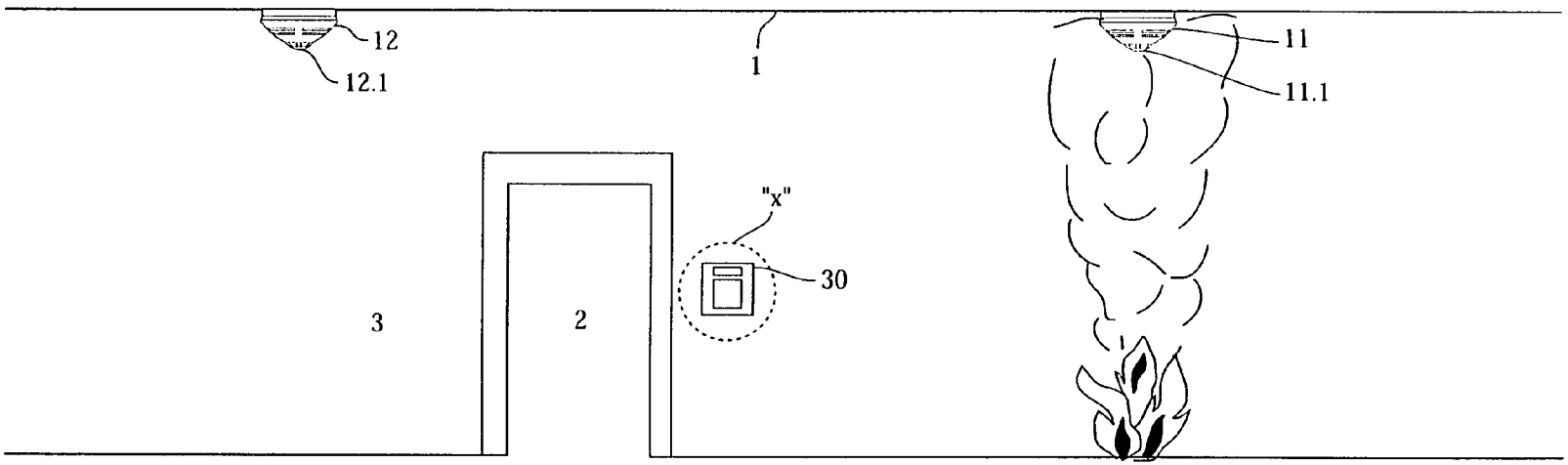
FIG. 1 shows the wall and the ceiling of an escape route in a building in a schematic simplified view.

According to FIG. 1, automatic emergency warning units (here in the form of smoke alarms 11 and 12) are attached on the ceiling 1 of a corridor at predetermined intervals. A manual emergency warning unit (here in the form of a push-button warning unit 30 which is mounted on a corridor wall 3) is situated next to a door or a passageway 2 to a further corridor which can be equipped in a similar fashion with emergency warning units.

Every automatic smoke alarm 11, 12 is connected to a central system (not shown) and comprises at least one highly luminous LED 11.1, 12.1 which usually has the function of an operating state indicator or with which the warning unit is equipped additionally.

Figure 2:
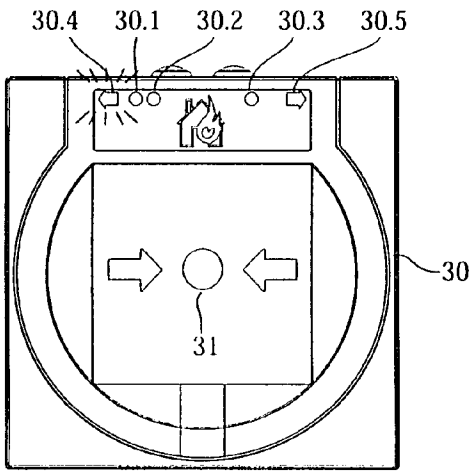
FIG. 2 shows the detail "X" in FIG. 1, i.e., a manual emergency warning unit in a representation on an enlarged scale.

The push-button warning unit 30 comprises according to FIG. 2 the push-button 31 which can usually be activated only after breaking the glass pane, or any other mechanism which can be activated manually and which initiates the transmission of an analog or digital signal to a central system (not shown) after its actuation. This push-button warning system has a window (among other things) which comprises, in addition to the printed symbol of a burning house, three LEDs 30.1, 30.2 and 30.3 for signaling the states of "operation", "alarm" and "malfunction", to which the colors of green, red and yellow are usually assigned. Close to the side edges of this window LEDs 30.4 and 30.5 are additionally arranged on each side in the physical form of an arrow. These LEDs 30.4 and 30.5 can be made to blink individually by the central system.

In the hazardous situation as shown in FIG. 1, the warning unit 11 responds to one or several phenomena that are the consequence of a fire (temperature, smoke, etc.) and sends a respective data message to the central system. Alternatively or additionally, a person pushes the push-button 30.1 of the push-button warning unit 30 which thereupon also sends an alarm signal to the central system. The computer in the central system then initiates the usual responses and alarms which are provided in case of a fire. In addition, the computer determines the escape routes to be used under consideration of the danger location localized by the alarm signal of the smoke alarm 11 and indicates the directions to be used on the escape routes to reach safe exits. From this data the computer generates trigger commands which put into the blinking mode the LED 12.1 of the smoke alarm 12 and the respective LEDs of all smoke alarms (not shown) following on the escape route(s), namely in such a time-offset manner that the impression arises for fleeing persons that there is a running light indicating the direction of escape. Alternatively or simultaneously, the computer activates the LED in the form of an arrow in all push-button warning units situated on the escape route(s) which designates the direction of the escape, which in the case of the push-button warning unit 30 is thus the LED 30.4. It also puts this LED in a blinking mode. Either all push-button warning units can optionally be triggered with the same blinking cycle or the trigger commands can be produced in a time-offset or optionally synchronous manner to the same like those for the automatic smoke alarms, so that the respective LEDs of successive push-button warning units produce their own running light effect or a running light effect included in the running light effect as produced by the automatic smoke alarms.

What is claimed is:

1. A method for signaling the direction of an escape route to be taken in an emergency in a building with emergency warning units that are arranged in a distributed manner and are connected to a central emergency warning system, comprising:

equipping individual emergency warning units with a sensor for detecting a hazard condition and luminous means; and activating the luminous means of the individual emergency warning units sequentially in the manner of a running light by the central emergency warning system in an emergency, which running light designates the escape route leading away from a hazard site.

2. The method as claimed in claim 1, further comprising:

storing information in the central emergency warning system, including all escape routes of the building, the physical location of all emergency warning units, and a program for determining at least one escape route to be chosen depending on one or more incoming emergency reports, which program calculates a beginning, a direction and an end of the at least one escape route leading away from the hazard site, and a sequence of the trigger commands for the luminous means of the emergency warning units to be activated.

3. A method as claimed in claim 1, wherein the central emergency warning system places the luminous means along the at least one escape route in a blinking mode.

4. A method as claimed in claim 3, wherein the central emergency warning system deactivates the luminous means along escape routes designated as unsuitable or hazardous escape routes.

5. A method as claimed in claim 2, wherein physical locations of illuminated escape route signs are stored in the central emergency warning system and are co-processed in the program for determining the at least one escape route.

6. An emergency warning unit for performing the method of claim 1, comprising:

a light emitting diode (LED) that continuously emits green light in an idle state and is switchable to a blinking mode during emergency conditions.

7. An emergency warning unit as claimed in claim 6, further comprising:

at least one additional, highly luminous, green LED that is switchable to a blinking mode by the central emergency warning system during emergency conditions.

8. An emergency warning unit as claimed in claim 7, wherein the at least one additional LED is physically configured as an arrow.

9. A manual, wall-mountable emergency warning unit for performing the method as claimed in claim 1, comprising:

two light emitting diodes (LEDs) arranged as arrows facing in opposite directions, wherein either of the two LEDs is configurable in a blinking mode by the central emergency warning system based on an existing emergency condition.

10. The method as claimed in claim 1, further comprising:

mounting the emergency warning units on the ceiling.

11. The method as claimed in claim 1, further comprising:

supplying power to individual emergency warning units from the central emergency warning system.

12. The method as claimed in claim 1, wherein activating the luminous means includes causing the luminous means to blink.

13. An emergency warning system for signaling the direction of an escape route to be taken in an emergency in a building, comprising:

a plurality of emergency warning units arranged in a distributed manner throughout the building, wherein individual emergency warning units comprise: a sensor for detecting a hazard condition and luminous means;

wherein, in response to receiving notification of a hazard condition detected by the sensor of an emergency warning unit, the emergency warning system activates the luminous means of the individual emergency warning units sequentially in the manner of a running light that designates at least one escape route leading away from a hazard site corresponding to the location of the emergency warning unit whose sensor detected the hazard condition.

14. The system of claim 13, wherein at least some of the emergency warning units are ceiling-mounted.

15. A wall-mountable emergency warning unit for signaling the direction of an escape route to be taken in an emergency in a building, comprising:

a user interface for manually triggering an alarm, the emergency warning unit notifying an emergency warning system in response to the alarm being triggered; and first and second LED indicators in the form of arrows pointing in opposite directions;

wherein one of the first and second LED indicators is activated by the emergency warning system in response to the alarm being triggered to designate an escape route leading away from a hazard site.

16. The wall-mounted emergency wall unit of claim 15, wherein the user interface is a push button interface.

17. An emergency warning system for signaling the direction of an escape route to be taken in an emergency in a building, comprising:

a plurality of wall-mounted emergency warning units according to claim 15, wherein the emergency warning system activates one of the first and second LED indicators of individual emergency warning units sequentially in the manner of a running light that designates at least one escape route leading away from a hazard site.

* * * * *